US005681508A

United States Patent [19]

Gerhardy

[11] Patent Number: 5,681,508

[45] Date of Patent: Oct. 28, 1997

[54] DIAPHRAGM CARBURETOR FOR AN INTERNAL COMBUSTION ENGINE

[75] Inventor: Reinhard Gerhardy, Korb, Germany

[73] Assignee: Andreas Stihl, Waiblingen, Germany

[21] Appl. No.: 618,478

[22] Filed: Mar. 18, 1996

[30] Foreign Application Priority Data

Mar. 18, 1995 [DE] Germany ..... 195 09 943.5

[51] Int. Cl.[6] ..... F02M 17/04

[52] U.S. Cl. ..... 261/35; 261/DIG. 68; 251/86; 137/505.46

[58] Field of Search ..... 261/DIG. 68, 35; 251/86, 333; 137/505.46, 505.47

[56] References Cited

U.S. PATENT DOCUMENTS

| | | | |
|---|---|---|---|
| 2,144,017 | 1/1939 | Gistucci | 261/DIG. 68 |
| 2,518,894 | 8/1950 | Humbarger et al. | 137/505.46 |
| 3,273,870 | 9/1966 | Johnson | 261/DIG. 68 |
| 3,305,207 | 2/1967 | Calderoni et al. | 251/86 |
| 3,326,513 | 6/1967 | Hall | 251/86 |
| 3,414,232 | 12/1968 | Hellman | 251/86 |
| 4,578,228 | 3/1986 | Gerhardy | 261/DIG. 68 |
| 4,852,853 | 8/1989 | Toshio et al. | 251/86 |
| 5,103,861 | 4/1992 | Lin | 137/505.46 |
| 5,283,013 | 2/1994 | Gerhardy | 261/DIG. 68 |

FOREIGN PATENT DOCUMENTS

| | | | |
|---|---|---|---|
| 624856 | 9/1961 | Italy | 261/DIG. 68 |

OTHER PUBLICATIONS

Hawley, The Condensed Chemical Dictionary, Tenth Ed., Oct. 1984, p. 997, Group 1305, PTO.

*Primary Examiner*—Tim R. Miles

*Attorney, Agent, or Firm*—Robert W. Becker & Associates

[57] ABSTRACT

A diaphragm carburetor for an internal combustion engine has a housing and a control chamber positioned in the housing and having a fuel inlet valve. A control diaphragm is positioned in the control chamber. A Venturi channel extends through the housing. At least one throttle valve is positioned in the Venturi channel. An idle valve and a main valve open into the Venturi channel and are connected with an idle valve channel, respectively, a main valve channel to the control chamber. A fuel pump is positioned in the housing. A fuel channel connects the fuel pump and the fuel inlet valve of the control chamber. A control lever that is actuated by the control diaphragm for controlling the fuel inlet valve is provided. The fuel inlet valve has a valve seat and a valve member with a sealing member cooperating with the valve seat for opening and closing the fuel inlet valve. The sealing element has a flat end face. The valve member is connected to the control lever.

11 Claims, 2 Drawing Sheets

50
61
62
60
51
52
41
13
16
18
59
42'
46
45
19
44
42
57
58
43
40
47
39
56
35
41
54
52
53
51
37
15
35'
55
36
38
50
49
48

DIAPHRAGM CARBURETOR FOR AN INTERNAL COMBUSTION ENGINE

BACKGROUND OF THE INVENTION

The present invention relates to a diaphragm carburetor for an internal combustion engine, especially for hand-held portable working tools such as motor chain saws, cutters, trimmers, etc., with a housing and at least one throttle positioned within the Venturi section of the housing and with an idle valve opening into the Venturi section as well as a main valve opening into the Venturi section. The idle valve is connected with an idle valve channel to a control chamber of the housing and the main valve is connected with a main valve channel to the control chamber. The carburetor further comprises a fuel pump with which fuel can be introduced via a fuel inlet channel and a fuel inlet valve into the control chamber. The fuel inlet valve is controlled by a control lever that is actuated by the control diaphragm positioned within the control chamber.

In known diaphragm carburetors the valve member is comprised of a guide body which with one end thereof supports the valve body. The other end of the guide body is received in a fork-shaped receiving element of a control lever. The control lever is pivotably supported at the housing of the diaphragm carburetor whereby the other end, on the one hand, is loaded by a control spring into the closed position of the fuel inlet valve and, on the other hand, is actuatable by the control diaphragm counter to the force of the spring in the opening direction of the fuel inlet valve. The valve member is guided in the stroke direction by a guide body within the fuel inlet channel. The guide body is supported with guide ribs extending over the circumference thereof in the longitudinal direction of the fuel inlet channel with radial play within the fuel inlet channel.

Depending on the construction of the engine, the diaphragm carburetor is directly positioned at the engine or in a vibration-dampened part of the working tool. Especially in the case of diaphragm carburetors that are directly connected to the engine, the carburetor is subjected to vibrations with increased amplitudes which act as acceleration forces onto the valve member and may cause an uncontrolled functioning of the fuel inlet valve. In order to prevent such malfunction, it has been suggested in the past to design the valve body such that it rests with first sealing surfaces, extending at a right angle to the opening direction, at an annular sealing surface that is parallel to the first sealing surfaces. However, it has been shown that with such a design only the forces that act transverse to the opening and closing direction of the valve remain without effect on the valve member, but that, however, the vibrations acting in the longitudinal direction of the valve member result in an acceleration of the mass of the valve member which causes an uncontrollable valve control action.

It is therefore an object of the present to provide a diaphragm carburetor according to the aforementioned kind with which vibrations and acceleration forces of the working tool, respectively, of the internal combustion engine remain without effect on the function of the fuel inlet valve.

SUMMARY OF THE INVENTION

The diaphragm carburetor for an internal combustion engine according to the present invention is primarily characterized by:

A housing;

A control chamber positioned in the housing and having a fuel inlet valve;

A control diaphragm positioned in the control chamber;

A Venturi channel extending through the housing;

At least one throttle valve, positioned in the Venturi channel;

An idle valve opening into the Venturi channel;

An idle valve channel connecting the idle valve to the control chamber;

A main valve opening into the Venturi channel;

A main valve channel connecting the main valve to the control chamber;

A fuel pump positioned in the housing;

A fuel inlet channel connecting the fuel pump and the fuel inlet valve of the control chamber;

A control lever actuated by the control diaphragm for controlling the fuel inlet valve;

The fuel inlet valve comprised of a valve seat and a valve member with a sealing member cooperating with a valve seat for opening and closing the fuel inlet valve;

The sealing element having a flat end face; and

The valve member connected to the control lever.

Advantageously, the fuel inlet valve has a bore for allowing passage of fuel into control chamber and the valve seat is an annular projection surrounding the bore.

Advantageously, the diaphragm carburetor further comprises a sleeve mounted within the fuel inlet line proximal to the control chamber, wherein the valve seat is connected to the sleeve.

Preferably, the fuel inlet line is a bore provided within the housing. The sleeve is pressed-fitted into the bore. The sleeve has an end projecting into the control chamber.

Preferably, the end of the sleeve has a radial shoulder.

In yet another embodiment of the present invention, the valve member and the sealing element are a unitary part comprising a head and a neck.

Preferably, the control lever comprises a recess and the sealing member is connected to the control lever by snapping into the recess.

Alternatively, the sealing member of the valve member is semi-spherical and has a semi-spherical surface. The control lever has a recess in the shape of a spherical section. The sealing member rests with the semi-spherical surface in the recess of the control lever.

Preferably, the valve member has a radial collar resting on the control lever and a recessed portion connecting the sealing member to the radial collar.

Advantageously, the valve member consists of a synthetic rubber material, preferably, a fluorine-substituted rubber.

Expediently, the control lever has a pivot axis and two arms extending in opposite direction away from the pivot axis such that the control lever is substantially straight. The pivot axis and points of force introduction to the control lever are substantially positioned in a common plane.

Advantageously, the control lever at the end of one arm has a projection facing the control diaphragm.

Advantageously, the control membrane comprises support plate with a control pin, wherein the control pin rests at the projection.

Due to the arrangement of the sealing member directly at the control lever the mass of the valve member can be reduced such that vibrations independent of the vibration direction, do not result in excitation of movable mass. Since the sealing member has a planar end face as a sealing surface, dimensional tolerances have no influence on the valve function. Also, dirt particles within the fuel do not result in leakage, a problem that can not be entirely precluded with needle valves. Since according to the present invention there is no valve member present which is guided within a bore over a corresponding axial length and is thus subject to frictional forces, the actuation forces for the valve can be reduced and the function of the fuel inlet valve can thus be improved over all.

According to a preferred embodiment of the invention, the valve seat is in the form of an annular projection which surrounds a bore. The diameter of this bore is determined according to the required throughput of fuel for the valve in maximal open position whereby a bore diameter of up to one millimeter is entirely sufficient. When smaller fuel amounts are required, the bore diameter can be substantially reduced, whereby it is especially preferred to provide a bore diameter of 0.5 mm. With respect to technological finishing considerations it is advantageous that the valve seat be provided at the end face of a sleeve to be fastened within the fuel inlet channel. In this manner, the position of the valve seat relative to fixed points of reference at the housing as well as with respect to the control lever can be easily adjusted so that manufacturing tolerances of the carburetor housing can be compensated in a simple manner. In this context it is especially advantageous that the sleeve be pressed-fitted into a bore of the housing and that a projection of this sleeve extend into the control chamber. In order to reliably prevent damage to the valve seat during mounting of the sleeve, it is advantageous that the sleeve be provided with a radial shoulder at its end which is projecting into the control chamber. Due to the arrangement of the valve seat within the control chamber, after completion of mounting of the sleeve, the proper functioning of the valve seat can be controlled in a simple manner. Also, a check-up of the valve seat for maintenance purposes is possible.

According to a further embodiment, the valve member is a unitary part and comprises a sealing member, a neck and head. Due to this design, the valve member can be simply introduced into a recess at the control lever by snapping the sealing member into the recess. Furthermore, it is advantageous that the sealing member of the valve member be semi-spherical so as to be supported with its semi-spherical surface within a recess that has the shape of a spherical segment. In this manner a ball and socket-like movability of the sealing member is achieved so that with reliability a sealing contact of the end face of the sealing element at the valve seat is ensured. As an alternative to the semi-spherical design, the sealing member may be provided with a radial collar which rests at the control lever, whereby the sealing member is connected with a recessed portion to the radial collar. Due to this recessed portion and the elasticity of the material, a limited movability results which allows for a deflection of the sealing member relative to its longitudinal axis. Advantageously, the valve member is comprised of a synthetic rubber material whereby fluorine-substituted elastomers are especially preferred.

The control lever comprises advantageously two arms and has a substantially straight shape. The point of force introduction as well as the pivot axis are at least approximately positioned in a common plane. In this manner, shape changes of the mounted lever, for example, by adjusting one arm into the required position, which is frequently required in the case of cut-to-length levers, are not necessary at all. In order for, the control arm ratio at the control lever to be constant so that there are no disadvantageous effects on the lever kinematics as a result of manufacturing and mounting tolerances, it is advantageous to provide the control lever at the end of one arm with a projection which faces the control diaphragm. The control diaphragm is provided with a diaphragm support and a control pin connected thereto which cooperates with the projection at the control lever.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

Figure 1:
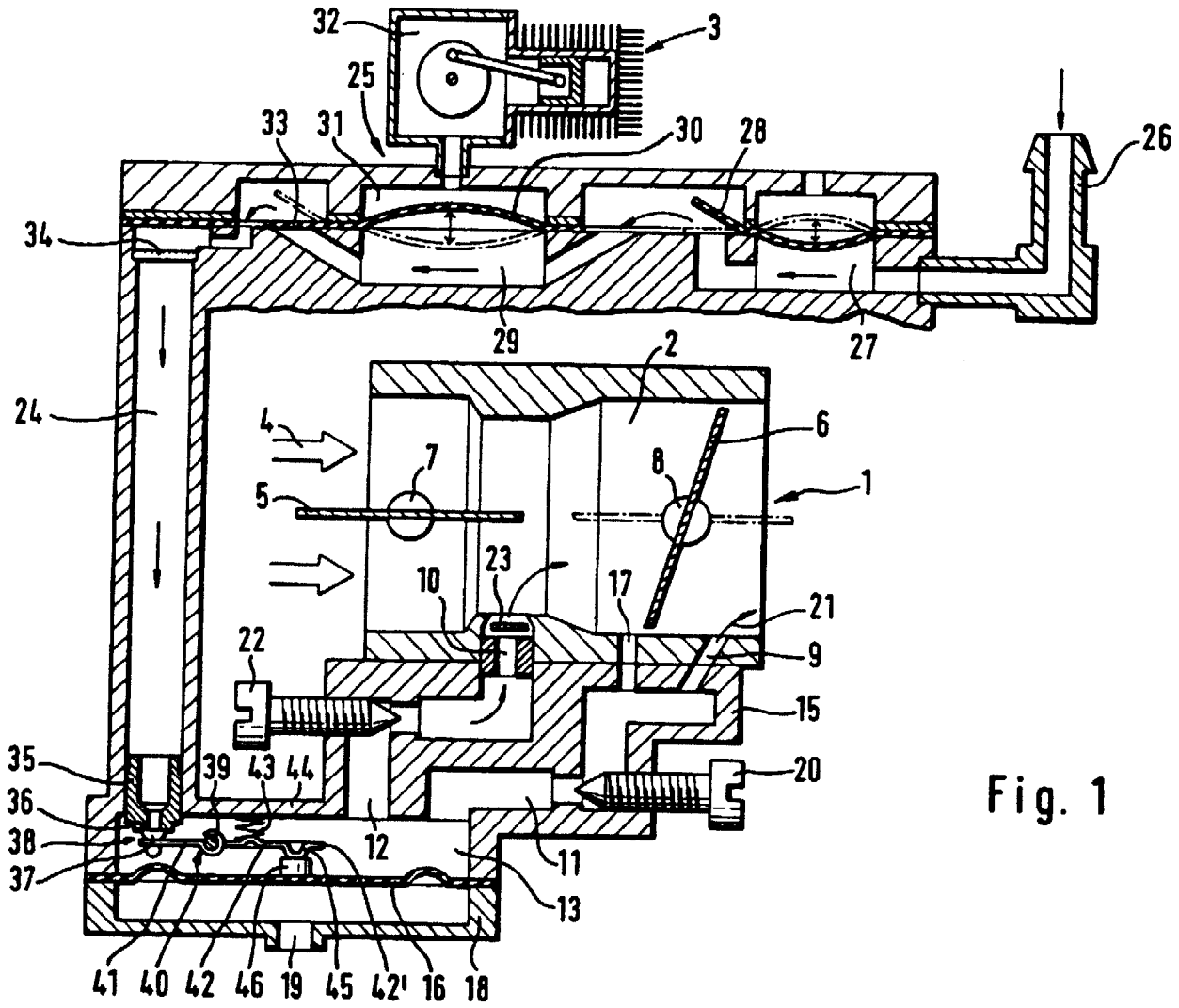
FIG. 1 shows a schematic representation of a diaphragm carburetor with a control chamber that is supplied with fuel by a diaphragm fuel pump.

FIG. 1 shows a diaphragm carburetor I which comprises a Venturi channel 2 which, in a manner not disclosed in detail, is flanged to the intake socket of an internal combustion engine 3, especially a two-stroke engine. Within the Venturi channel 2, in the direction of flow 4 of the combustion air, a first and second throttle valve 5 and 6 are arranged which are pivotably supported with throttle shafts 7 and 8 within the Venturi channel 2. In the shown embodiment, the throttle valve 6 is in idle position and the throttle valve 5 is in open position.

In the direction of flow 4 downstream of the throttle valve 5 and upstream of the throttle valve 6 a main valve 10 opens into the Venturi channel 2. In flow direction 4 an idle valve 9 opens into the Venturi channel 2 downstream of the throttle valve 6. The idle valve 9 is connected with an idle valve channel 11 and the main valve 10 is connected with the main valve channel 12 to the fuel-filled control chamber 13 which is embodied within the housing 15 of the diaphragm carburetor 1 and limited by the control diaphragm 16. The control diaphragm 16 is loaded on the side facing away from the control chamber 13 by atmospheric pressure. For this purpose the housing cover 18 is provided with an opening 19.

With an idle screw 20 the throughput of the idle valve channel 11 to the idle valve 9 is adjustable. Downstream of the idle screw 20 a bypass bore 17 opens into the idle valve channel 11. Air is supplied via bore 17 during idling from the area upstream of the throttle valve 6 of the channel 2 so that via the idle valve 9 a fuel air emulsion is produced in the direction of arrow 21.

A full load screw 22 is arranged within the main valve channel 12 with which the maximum throughput through the main valve channel 12 is adjustable. Furthermore, the main valve 10 is closed by a valve plate 23 which opens as a check valve into the Venturi channel 2 and during idling tightly seals the main valve 10 due to the resulting pressure conditions.

Fuel which is pumped with a diaphgram fuel pump 25 via the intake socket 26 from a non-represented fuel tank is introduced into the control chamber 13 via fuel inlet channel 24. The fuel flows from the intake socket 26 first into the compensating chamber 27 and from there via the check valve 28 in the form of a flat valve into the pump chamber 29 of the fuel pump 25. The pump chamber 29 is separated by a diaphragm 30 from the drive chamber 31 of the fuel pump 25. The drive chamber 31 is loaded by the changing interior pressure of the crank case 32 of the two-stroke combustion engine 3 that is to be supplied with the fuel air mixture by the diaphragm carburetor 1.

When a vacuum is present in the crankcase 32, the diaphragm 30 is curved in the manner shown in the drawing so that the volume of the drive chamber 31 is reduced and a vacuum is produced within the pump chamber 29. In this manner, fuel is sucked into the pump chamber 29 via the open check valve 28. When the interior pressure of the crankcase changes to a positive pressure, the membrane 30 is deflected in the sense of a volume reduction of pump chamber 29 and the fuel within the pump chamber 29 is pressure-loaded. The check valve 28 closes and the check valve 33, which is arranged at the pressure side of the fuel pump 25 and is also in the form of a flap, opens. The fuel is thus pumped via a fine mesh filter 34 into the fuel inlet channel 24 and into the control chamber 13.

In the area where the fuel inlet channel 24 opens into the control chamber 13 a sleeve 35 is arranged which has formed thereat a valve seat 36 at the end face which is facing the control chamber 13. The valve seat 36 has coordinated therewith a valve member 37 made of synthetic rubber material, preferably a fluorine-substituted elastomer, whereby valve seat 36 and valve member 37 form a fuel inlet valve 38. The valve member 37 is connected to an arm 41 of a pivotable control lever 40 that can be pivoted about a bearing 39 fixably connected to the housing. The other arm 42 extends to the center of the control chamber 13 so that its end 42' is positioned opposite the center of the control diaphragm 16. The arm 42 of the control lever 40 is loaded into the closed position of the fuel inlet valve 38 by a control spring 43 which is supported at the housing wall 44 that delimits the control chamber 13. At the end 42' of the arm 42 a projection 45 is provided which is facing the control diaphragm 16 and with which the control lever 40 is in contact with a control pin 46 so that the control lever 40 can assume a position which corresponds to force equilibrium of the forces, exerted by the control spring 43 and the control diaphragm 16, onto the control lever 40.

Figures 2, 3:
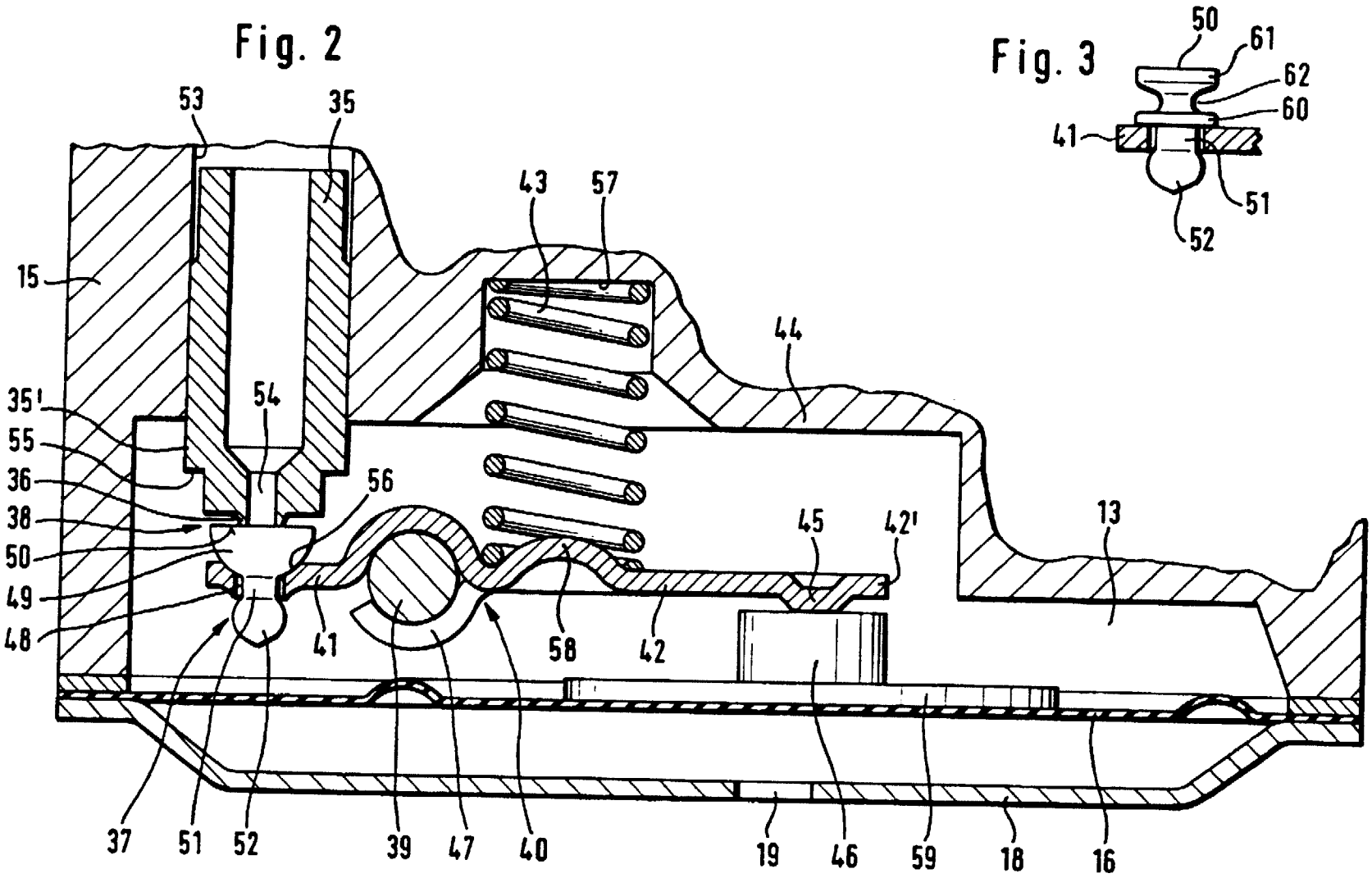
FIG. 2 shows in detail the control chamber and the fuel inlet valve of the diaphragm carburetor.
FIG. 3 shows a variant of the sealing member.

FIG. 2 shows in detail the control chamber 13 with control lever 40 and fuel inlet valve 38 arranged therein. The control lever 40 is comprised of sheet metal that is shaped by stamping or bending whereby the shaping is carried out in a single working step. At its center portion the control lever 40 is provided with a contour that corresponds to the bearing 39 whereby the control lever 40 is formed to a bearing sleeve 47 in a section plane which is outside of the plane of FIG. 2. The arm 41 is provided with a recess 48 into which the valve member 37 is snapped. The valve member 37 comprises a substantially semi-spherical sealing member 49 having a planar end face 50 which faces the seat 36 provided at the sleeve 35. It further comprises a neck 51 extending through the arm 41 and a head 52 connected thereto with which the sealing member is securely connected to the control lever 40.

The housing 15 has a bore 53 which formes the fuel inlet channel 24 and into which a sleeve 35 is press-fitted such that an end 35' projects into the control chamber 13 so that the end face 50 of the sealing member 49 comes into contact with the valve seat 36. The valve seat 36 surrounds as an annular projection a throttle bore 54 which preferably has a diameter of 0.5 mm. The sleeve 35 is further provided with a shoulder 55 which can be engaged by a tool for press-fitting the sleeve 35 into bore 53. In order for the end face 50 of the sealing member 49 to be securely and tightly positioned at the valve seat 36, it is expedient that the sealing member 49 is secured at the arm 41 so as to be movable to a limited extend. For this purpose, the edge of the recess 48 is embodied as a recess 56 in the shape of a spherical segment so that the sealing member 49 with its curved surface engages in the manner of a ball-and-socket joint the arm 41 of the control lever 40.

As can be seen in FIG. 2 in further detail, the housing wall 44 is provided with a recess 57 in which one end of the control spring 43 is received. The control lever 40 comprises an arm 42 with a stamped curved portion 58 which extends into the end of the control spring 43 so that the control spring 43 is securely held at the control lever 40 as well as at the housing wall 44. The projection 45 which is positioned closed to the end 42' of the arm 42 rests at the control pin 46 which is supported by the support plate 59. The support plate 59 serves to provide the required form and shape stiffness to the diaphragm so that the diaphragm movement results in a defined stroke of the control pin 46 and thus in a defined pivoting movement of the control lever 40. The side of the control diaphragm 16 facing away from the control chamber 13 is covered by the housing cover 18 that has an opening 19.

As can be seen in FIG. 2, the control lever 40 is substantially of a straight embodiment so that the points of force introduction at the control lever 40 as well as its pivot axis and the sealing member 49 are substantially approximately positioned within a common plane. In order to ensure that the control arm ratio of the control lever 40 remains constant, the projection 45 is provided which defines the point of force introduction of the control pin 46. Thus, even a lateral displacement of the control pin 46 due to manufacturing and mounting tolerances of the control diaphragm 16 has no disadvantageous effects on the kinematics of the lever.

For mounting the sleeve 35 and adjusting the inlet valve function, the sleeve 35 is first forced into the bore 53 whereby the end 35' of the sleeve 35 projects to some extend into the control chamber 13, as can be seen in FIG. 2. Subsequently, control spring 43 is inserted into the recess 57 and the control lever 40 is mounted on the bearing 39 whereby the control lever 40 assumes a position with a pivot angle counter to the force of the control spring 43. The sealing member 49 is brought into contact at the valve seat 36 by pivoting of the control lever 40 whereby the control lever 40, however, can not yet assume the normal position represented in FIG. 2. In order to adjust the control lever 40 to this normal position and to thereby also adjust the function of the fuel inlet valve 38, a tool is applied to the shoulder 55 and the sleeve 35 is then press-fitted into the bore 53 to such an extend that the control lever 40 is exactly positioned in its normal position. In this manner, the fuel inlet valve is reliably adjusted in a simple manner without requiring further measures.

Instead of the ball-and-socket-type movability of the sealing member 49 at the arm 41 of the control lever, it is also possible to use the embodiment shown in FIG. 3. The arm 41 is without recess and provides support for a radial collar 60 of the valve member 37. The valve member 37 is secured with the head 52 at the arm 41 as has been disclosed in connection with FIG. 2. The relative movability of the sealing member for compensating possible angles between the end face 50 and the valve seat is provided by the recessed portion 62 between the sealing members 61 and the radial collar 60 as well as with a sufficient elasticity of the material of the valve member 37.

The present invention is, of course, in no way restricted to the specific disclosure of the specification and drawings, but also encompasses any modifications within the scope of the appended claims.

What I claim is:

1. A diaphragm carburetor for an internal combustion engine; said diaphragm carburetor comprising:

a housing;

a control chamber positioned in said housing and having a fuel inlet valve;

a control diaphragm positioned in said control chamber;

a Venturi channel extending through said housing;

at least one throttle valve positioned in said Venturi channel;

an idle valve opening into said Venturi channel;

an idle valve channel connecting said idle valve to said control chamber;

a main valve opening into said Venturi channel;

a main valve channel connecting said main valve to said control chamber;

a fuel pump positioned in said housing;

a fuel inlet channel connecting said fuel pump and said fuel inlet valve;

a control lever actuated by said control diaphragm for controlling said fuel inlet valve;

said fuel inlet channel including a bore provided in said housing and having an end opening into said control chamber, said fuel inlet valve positioned at said end opening into said control chamber;

a sleeve press-fitted into said bore and having a sleeve end with an end face projecting into said control chamber;

said fuel inlet valve comprised of a valve seat and a valve member with a sealing member cooperating with said valve seat for opening and closing said fuel inlet valve, wherein said valve seat is an annular projection projecting from said end face of said sleeve end;

said sleeve end having a radial shoulder parallel to said end face; said sealing member having a flat end face; and said valve member connected to said control lever.

2. A diaphragm carburetor according to claim 1, wherein said sleeve has a bore for allowing passage of fuel into said control chamber and wherein said annular projection surrounds said bore.

3. A diaphragm carburetor according to claim 1, wherein said valve member and said sealing element are a unitary part comprising a head and a neck.

4. A diaphragm carburetor according to claim 3, wherein said control lever comprises a recess and wherein said sealing member is connected to said control lever by snapping into said recess.

5. A diaphragm carburetor according to claim 3, wherein:

said sealing member of said valve member is semispherical and has a semi-spherical surface;

said control lever has a recess in the shape of a spherical section; and said sealing member rests with the semi-spherical surface in said recess of said control lever.

6. A diaphragm carburetor according to claim 3, wherein said valve member has a radial collar resting on said control lever and a recessed portion connecting said sealing member to said radial collar.

7. A diaphragm carburetor according to claim 1, wherein said valve member consists of a synthetic rubber material.

8. A diaphragm carburetor according to claim 7, wherein said rubber material is a fluorine-substituted rubber.

9. A diaphragm carburetor according to claim 1, wherein said control lever has a pivot axis and two arms extending in opposite directions away from said pivot axis such that said control lever is substantially straight, wherein said pivot axis and points of force introduction into said control lever are substantially positioned in a common plane.

10. A diaphragm carburetor according to claim 1, wherein said control lever at the end of one arm has a projection facing said control diaphragm.

11. A diaphragm carburetor according to claim 10, wherein said control membrane comprises a support plate with a control pin, wherein said control pin rests at said projection.

* * * * *